United States Patent [19]

Burkey

[11] 4,385,448

[45] May 31, 1983

[54] BOW SIGHT

[76] Inventor: Larry Burkey, 2805 Bella Vista Dr., Oklahoma City, Okla. 73110

[21] Appl. No.: 281,680

[22] Filed: Jul. 9, 1981

[51] Int. Cl.[3] ..... F41G 1/46

[52] U.S. Cl. ..... 33/265

[58] Field of Search ..... 33/265; 124/87

[56] References Cited

U.S. PATENT DOCUMENTS

| | | | |
|---|---|---|---|
| 2,767,472 | 10/1956 | Kocur | 33/265 |
| 3,234,651 | 2/1966 | Rivers | 33/265 |
| 3,308,540 | 3/1967 | Dean | 33/265 |
| 3,670,422 | 6/1972 | Stebbins et al. | 33/265 |
| 4,120,096 | 10/1978 | Keller | 33/265 |
| 4,136,462 | 1/1979 | Topel | 33/265 |
| 4,244,115 | 1/1981 | Waldorf | 33/265 |

*Primary Examiner*—Richard R. Stearns
*Attorney, Agent, or Firm*—William R. Laney

[57] ABSTRACT

A sight for attachment to an archer's bow which includes a rectangular frame having a tensioned wire projecting between opposite sides thereof. A plurality of spaced sight beads are slidably and adjustably mounted on the wire to enable a target at various ranges to be sighted. A light window is formed in a third side of the frame in a direction substantially parallel to the wire, and fastening devices project from the fourth side of the frame to facilitate adjustable securement of the sight to a mounting bracket attached to the bow.

9 Claims, 7 Drawing Figures

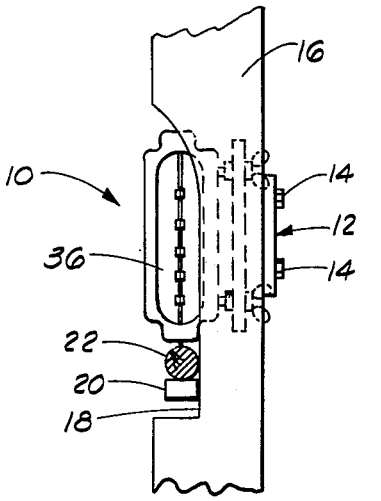
FIG. 1
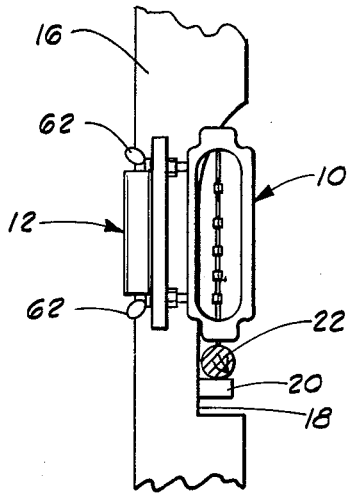
FIG. 2
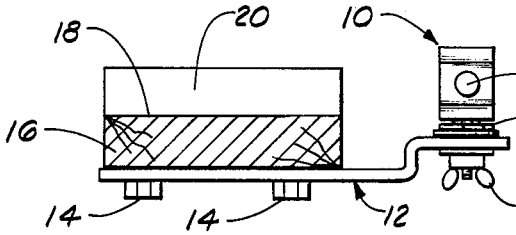
FIG. 3
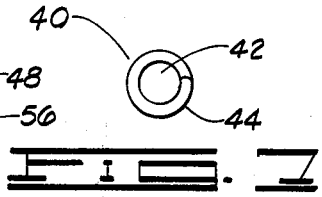
FIG. 7
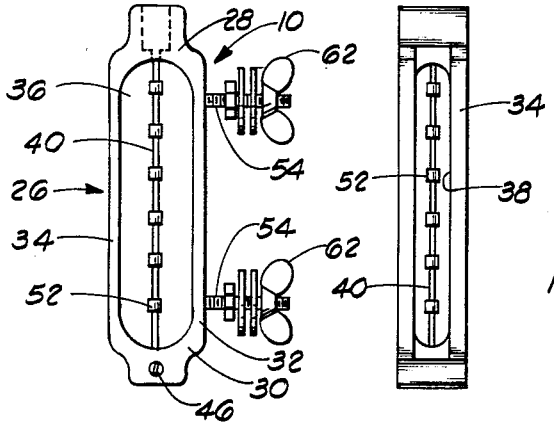
FIG. 4
FIG. 5
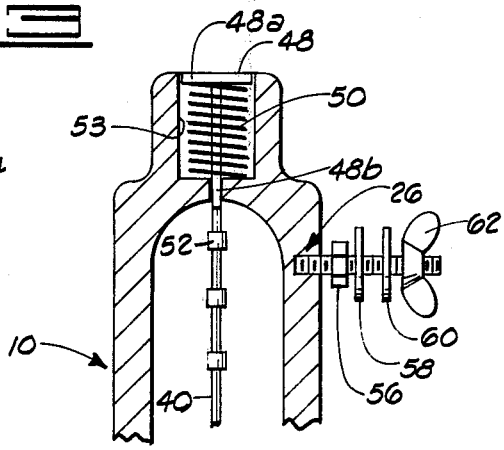
FIG. 6

BOW SIGHT

BACKGROUND OF THE INVENTION

1. Field of the Invention

This invention relates to bow sights used for sighting a target preparatory to shooting an arrow from an archer's bow.

2. Brief Description of the Prior Art

A number of patents have previously been issued on various types of bow sights. The closest of these patents, in concept, to the present invention is that which was issued to Russell C. Rivers on Feb. 15, 1966 and assigned U.S. Pat. No. 3,234,651. The Rivers patent discloses a bow sight formed by a C-frame where a filament is extended between the free ends of the legs of the C-frame and is placed in tension as the legs spring away from each other after the filament has been secured to the legs. A plurality of small spherical beads are secured to the filament as spaced intervals. Securement of the beads to the filament is attained by extending the filament through a diametric bore through each bead and wrapping it around a part of the outer periphery of the bead. Only by springing the frame legs toward each other can these beads be adjusted in their position along the filament in order to accommodate for different target conditions and different shooting conditions.

The Rivers patent ostensibly aids the archer who is hunting with a bow and arrow in that the bow sight is claimed to be more protected from contact with branches, twigs and leaves as the archer moves through the underbrush and other natural obstacles. The problem adverted to is real, and the Rivers sight, in allegedly offering minimized obstruction to the viewing of moving game, and also to contact with brush and other objects tending to damage the sight, claims an advance over the prior art constituted by sights having projecting pegs or prongs used as the sighting elements.

Many patents have been issued on the latter type sights. Typical of such sights are the type shown in Topel's U.S. Pat. No. 4,136,462. Other patents which have been issued on bow sights of this general character are shown in the following U.S. patents which are known to me:

U.S. Pat. No. 4,136,461, Max Gasser
U.S. Pat. No. 2,163,503, J. R. Tate
U.S. Pat. No. 4,120,096, Charles R. Keller
U.S. Pat. No. 2,963,503, Tate
U.S. Pat. No. 2,574,599, Stieber
U.S. Pat. No. 2,875,522, Merrill et al.
U.S. Pat. No. 3,245,393, Rose
U.S. Pat. No. 3,450,122, Diamond
U.S. Pat. No. 3,455,027, Perkins
U.S. Pat. No. 3,674,002, Diamond, Sr.
U.S. Pat. No. 3,849,894, Brougham
U.S. Pat. No. 3,866,592, Carella
U.S. Pat. No. 3,871,105, Brougham
U.S. Pat. No. 4,020,560, Heck
U.S. Pat. No. 4,026,032, Smith
U.S. Pat. No. 4,048,726, LeFebvre

GENERAL DESCRIPTION OF THE PRESENT INVENTION

A present invention provides an improved sight for use by archers in sighting a target, with the sight affording compensation for range variations and for windage and other variant shooting conditions. The actual sight elements employed can be shifted both laterally relative to the line of travel of the arrow, as well as up and down in affording allowance for target range differences.

Broadly described, the bow sight of the invention includes a rigid rectangular frame having a large opening in the center of the frame, and further having a tensioned sight wire projecting between opposite sides of the frame, and a vertical plane extending substantially parallel to, or aligned with, the line of flight of the arrow. A plurality of spaced, variously colored sight beads or elements are slidably and adjustably mounted on the wire to enable a target at various ranges to be sighted by the use of such sight elements. The sight elements and the sight wire are constructed so that the elements tightly engage the wire during use of the sight, but may nevertheless be manipulated easily by the fingers of the archer where adjustments are needed to adapt the sight to different types of bows, weights of arrows and shooting conditions.

The sight includes an elongated sight window formed through one side of the frame for admitting light from a lateral direction for the purpose of illumination of the sight elements. Means is provided for constantly tensioning the sight wire, and the entire sight assembly is constructed so that replacement of the sight wire and the sight elements carried thereon can be easily and quickly effected.

An important object of the invention is to provide a bow sight which is ruggedly constructed and is configured so that the more fragile elements of the sight, such as the sight wire and the sight elements, are protected from contact with brush, twigs, trees and the like as the archer moves through a thicket or heavily overgrown area.

Another object of the invention is to provide a bow sight which can be very quickly mounted upon a mounting bracket fastened to a bow, and which is adjustable on such mounting bracket to shift the sighting elements of the sight laterally as may be needed to compensate for windage or other conditions affecting the line of flight of the arrow.

An additional object of the invention is to provide a bow sight which can be quickly and easily adjusted for use under different conditions and with different styles and types of bows and arrows.

A further object of the invention is to provide a bow sight which is mechanically rugged and characterized in having a long and trouble-free operating life, but which can be quickly repaired in the event that the sight is damaged during use thereof by the archer.

Additional objects and advantages will become apparent as the following detailed description is read in conjunction with the accompanying drawings which illustrate a preferred embodiment of the invention.

GENERAL DESCRIPTION OF THE DRAWINGS

FIG. 1 is a side elevation view of the bow sight of the invention mounted on a support bracket which is secured to a bow.

FIG. 2 is a side elevation view of the bow sight of the invention as it is mounted on a supporting bracket secured to a bow, and showing the bow sight as it appears when viewed 180° from the view appearing in FIG. 1.

FIG. 3 is a composite sectional view through the bow and plan view of a mounting bracket and the bow sight of the invention adjustably secured to such mounting bracket.

FIG. 4 is an enlarged front elevational view of the bow sight.

FIG. 5 is a view in elevation of the bow sight when the bow sight is pivoted through 90° from the position shown in FIG. 4.

FIG. 6 is a view in elevation of a detail of the bow sight construction showing the manner in which the sight wire is secured to one end of the sight wire frame and is retained in tension.

FIG. 7 is a sectional view taken transversely through the sight wire.

DETAILED DESCRIPTION OF A PREFERRED EMBODIMENT OF THE INVENTION

In FIG. 1, the bow sight of the invention is designated generally by reference numeral 10 and is shown mounted upon a conventional mounting bracket 12 which is attached by screws 14 to one side of the bow 16. The bow 16 has a sighting notch or window 18 of conventional construction formed in one of the longitudinal edges thereof and further has an arrow rest 20 projecting into the notch for supporting the shaft 22 of an arrow as the arrow is aimed preparatory to shooting.

The bow sight 10 is illustrated in detail in FIGS. 4–7. The sight 10 includes a rigid rectangular frame 26 which includes a pair of opposed end frame members 28 and 30 and a pair of opposed, substantially parallel side frame members 32 and 34. A relatively large open space 36 is defined centrally within the frame 26. An elongated slot 38 is formed in the side frame member 34 and constitutes a light window admitting light from the side of the frame into the central opening 36 to enhance the visibility of the sight wire sight elements hereinafter described.

Extending from one of the end frame members to the other is an elongated sight wire 40. The sight wire 40 is a compound wire having a straight central core element 42 and an external, helically wrapped nickel wire 44 extending around the central core. The sight wire 40 is characterized in having a relatively good elastic memory characteristic so that it can be placed in tension over an extended period of time without undergoing permanent elongation or stretching. One end of the sight wire 40 is fixed in the end frame member 30 by means of a set screw 46 extended through this end frame member and against an end portion of the sight wire.

The opposite end of the sight wire 40 is connected to a tension bolt or rivet 48 which includes an elongated shaft secured at one of its ends **48*b* to the sight wire, and at its other end to a flat head 48*a*. A helically coiled tension spring 50 surrounds the shaft of the tension bolt 48 for urging the head of the bolt 48 in an axial direction relative to the sight wire and away from the frame 26** to retain the sight wire in tension.

The bolt 48 and tension spring 50 are positioned in a cavity 53 formed axially into the end frame member 28.

It will be perceived in referring to FIGS. 4 and 6 that the sight wire 40 is positioned within the frame 26 so as to bisect the frame. Positioned on the sight wire 40 at axially spaced intervals therealong are a plurality of small tubular sight elements 52. The tubular sight elements 52 are variously colored to provide range indications to be used by the archer in sighting in the bow on a target. In the illustrated embodiment, each of the sight elements 52 is in the form of a small cylinder which is centrally bored so as to tightly frictionally engage the sight wire.

For the purpose of adjustably mounting the bow sight 10 on the mounting bracket 12 carried by the bow 16, the bow sight has a pair of outwardly projecting threaded screw shafts 54 tapped into, and secured to, the side frame member 32. The screw shafts 54 are spaced along the frame member and extend substantially normal thereto. As best illustrated in FIG. 6, each of the threaded screw shafts 54 carries thereon, a pile nut 56, a pair of washers 58 and 60 and, near the outer end of the respective screw shaft, a wing nut 62. As shown in FIG. 3, the sight 10 is mounted on the bracket 12 by extending the threaded screw shafts 54 through an elongated slot (not shown) formed in a portion of the bracket 12, with the pile nuts 56 and one of the washers 58 carried on each screw shaft located on one side of the bracket, and the wing nuts 62 and the other of the two washers 60 positioned on the opposite side of the mounting bracket. Various types of slotted mounting brackets are currently used for mounting bow sights and, in general, the sight of the present invention can be mounted on substantially any of these brackets having an elongated slot for the accommodation of fastening members forming a part of bow sights now in use.

In the use of the bow sight of the invention, it is first mounted to the mounting bracket by the use of the pile nuts 56 and wing nuts 62. The pile nuts 56 can be adjusted axially along their respective threaded screw shafts 54 to properly cant and orient the sight 10 for the particular conditions under which the bow is to be employed. Thus, the windage may be compensated by proper adjustment of the sight 10 on the bracket 12. It is also possible to move the entire sight 10 axially relative to the bow 16 by sliding the threaded screw shafts 54 in one direction or the other in the slot in the mounting bracket 12 through which these screw shafts project.

After the sight has been initially set to the preadjusted position desired upon the mounting bracket 12, the sighting elements 52 are themselves adjusted along the sight wire 40. The sighting elements 52 are variously colored and are color correlated to various ranges at which the target to be sighted by the archer is located relative to the shooting position. One of the important advantages of the present invention is the ease with which the sighting elements 52 may be individually and independently adjusted along the length of the sight wire 40. Thus, each sight element 52, while being dimensioned to relatively tenaciously frictionally engage the sight wire 40 to thereby avoid inadvertent displacement along the sight wire due to contact with brush and the like, is nevertheless susceptible to adjustible displacement by the archer by gripping the particular sight element to be adjusted and sliding it along the sight wire 40 in the required direction. When the bow sight 10 has been properly adjusted, both laterally, as for windage and the like, and in terms of the target range by adjustment of the sight elements 52 along the sight wire 40, the archer employs the sight in a manner well understood in the art. Thus, by aligning the line of sight between the eye and the target with a particular one of the sight elements by shifting of the bow to attain such alignment, the archer compensates for the fall of the arrow from a straight line of travel in the course of its progression toward the target over the particular range to the target which may be involved.

In the use of the bow sight, the sight wire 40 and sight elements 52 are protected from contact with brush by the surrounding frame of the sight. Moreover, the inclusion of the light window 38 in the sight frame member 34 of the bow sight assures that full illumination of the sight wire 40 and the sight elements 52 is afforded under most shooting conditions.

An important feature of the invention is the fact that each of the sight elements 52 is individually adjustable along the sight wire 40 without disturbance of, or the need to manipulate, the other sight elements unless this should be desirable.

Another important feature of the invention is the characteristic of the sight wire 40 of maintaining a tensioned condition over extended periods of time. This results from the particular unique construction of the sight wire and also from the continuous tensioning effect of the tension spring 50. At such time as it may be desirable to replace either the sight wire 40 or any of the sight elements 52, this can be easily accomplished by loosening the set screw 46 and removing the sight wire 40, tension spring 50 and tension bolt 48 from the bow sight. A new sight wire 40 can then be attached to the shank of the tension bolt 48 or, if it is desired to replace or add sight elements 52 to the sight wire, this can be done by threading the sight elements onto the end of the sight wire opposite that end which is attached to the tension bolt 48.

The nickel construction of the sight wire assures that it resists rusting or oxidation under inclement weather conditions over an extended period of time.

It is also important to note that in the event the sight wire 40 becomes snagged or impaled upon projecting brush or twigs, it can yield as a result of the yielding tensioning effected by the tension spring 50. Thus, the spring 50 can undergo compression to allow some departure from linearity of the sight wire 40, and thus avoid breaking of the sight wire if it should be impaled or snagged.

Although a preferred embodiment of the invention has been herein described in order to enlighten those skilled in the art as to how the invention may be practiced, it will be understood that various changes and modifications in the illustrated and described structure can be effected without departure from the underlying basic principles of the invention. Changes and innovations of this type are therefore deemed to be circumscribed by the spirit and scope of the invention except as the same may be necessarily limited by the appended claims, or reasonable equivalents thereof.

What is claimed is:

1. A sight for an archer's bow comprising:

a rigid frame having a central opening therein;

a flexible sight wire extending across the opening and having its opposite ends engaged with the frame, said sight wire having a straight central core, and having a nickel wire wrapped helically around said central core; and a plurality of spaced sight elements surrounding and frictionally engaging the sight wire and manually slidable on the sight wire.

2. A sight as defined in claim 1 wherein said frame is of rectangular configuration around said central opening, and a side of said frame defines a light window disposed in substantially coplanar alignment with said opening for affording natural illumination to said sight wire and sight elements.

3. A sight for an archer's bow comprising:

a rigid frame having a central opening therein;

a flexible sight wire extending across the opening and having its opposite ends engaged with the frame;

resilient means carried on said frame and constantly yieldingly urging said sight wire to a tensioned status; and a plurality of spaced sight elements surrounding and frictionally engaging the sight wire and manually slidable on the sight wire.

4. Claim 3 wherein said resilient means comprises:

a tension bolt having a shank connected to one end of said sight wire and having a head; and a tension spring around said bolt shank and bearing at one end against said bolt head and at the other end against said frame.

5. Claim 4 wherein said frame is of rectangular configuration around said central opening, and a side of said frame defines a light window disposed in substantially coplanar alignment with said opening for affording natural illumination to said sight wire and sight elements.

6. Claim 5 wherein said sight wire is a compound wire having a straight central core, and having a nickel wire wrapped helically around said central core.

7. A sight for an archer's bow as defined in claim 3 wherein said frame is of rectangular configuration around said central opening, and a side of said frame defines a light window disposed in substantially coplanar alignment with said opening for affording natural illumination to said sight wire and sight elements.

8. A sight for an archer's bow comprising:

a rigid frame of rectangular configuration having a central opening therethrough, and further having a light window defined by one side of said frame and disposed in substantially coplanar alignment with said central opening for affording natural illumination of the space within said central opening;

a flexible sight wire extending across the central opening substantially parallel to the side of said frame defining said light window and having a portion crossing said central opening which is substantially coextensive in length with said light window, said flexible sight wire having its opposite ends engaged with said frame; and a plurality of spaced sight elements surrounding and frictionally engaging the sight wire and manually slidable on the sight wire.

9. A sight for an archer's bow comprising:

a rigid frame of rectangular configuration and extending around and defining a central opening, said frame further defining in one side thereof, a light window located in substantially coplanar alignment with said central opening for enhancing natural illumination within said central opening;

a flexible sight wire extending across said central opening and substantially parallel to said light window, and having opposite end portions releaseably engaged with said frame;

a tension bolt connected to a first one of said end portions of said sight wire and having a head;

spring means engaging said tension bolt and said frame for tensioning said sight wire across said opening; and screw means extending through said frame at a location adjacent the second end portion of said sight wire for detachably engaging said second end portion of said sight wire whereby, when said screw means is loosened in its engagement with said sight wire, said sight wire may be completely removed from said frame by extraction of said tension bolt and spring means from a location in engagement with said frame; and a plurality of spaced sight elements surrounding and frictionally engaging the sight wire and manually slidable on the sight wire and removeable from said frame with the sight wire.

* * * * *